US010442188B2

(12) United States Patent
Watanabe et al.

(10) Patent No.: US 10,442,188 B2
(45) Date of Patent: Oct. 15, 2019

(54) LIQUID EJECTING HEAD AND LIQUID EJECTING APPARATUS

(71) Applicant: SEIKO EPSON CORPORATION, Tokyo (JP)

(72) Inventors: Shunsuke Watanabe, Matsumoto (JP); Fumiya Takino, Shiojiri (JP); Shingo Tomimatsu, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/422,991

(22) Filed: Feb. 2, 2017

(65) Prior Publication Data

US 2017/0225457 A1 Aug. 10, 2017

(30) Foreign Application Priority Data

Feb. 10, 2016 (JP) ..... 2016-023732
Sep. 21, 2016 (JP) ..... 2016-184255

(51) Int. Cl.
*B41J 2/045* (2006.01)
*B41J 2/14* (2006.01)

(52) U.S. Cl.
CPC ..... *B41J 2/04541* (2013.01); *B41J 2/04581* (2013.01); *B41J 2/14233* (2013.01); *B41J 2002/14241* (2013.01); *B41J 2002/14491* (2013.01); *B41J 2202/11* (2013.01)

(58) Field of Classification Search
CPC ..... B41J 2/14233; B41J 2002/14491; B41J 2002/14241; B41J 2202/11; B41J 2002/14459; B41J 2002/14306; B41J 2/04541; B41J 2/04581; B41J 2/14201; B41J 2/161; B41J 2/175
USPC ..... 347/68, 71
See application file for complete search history.

(56) References Cited

U.S. PATENT DOCUMENTS

2002/0171711 A1 11/2002 Okuda et al.
2006/0164466 A1 7/2006 Mizuno
2006/0209137 A1 9/2006 Kojima et al.
2006/0290747 A1* 12/2006 Shimada ..... B41J 2/14233 347/68
2007/0263041 A1 11/2007 Owaki
2008/0002001 A1 1/2008 Enomoto et al.
2008/0238980 A1 10/2008 Nagashima
(Continued)

FOREIGN PATENT DOCUMENTS

EP 1506863 A1 2/2005
JP 2007-301736 11/2007
(Continued)

OTHER PUBLICATIONS

European Search Report issued in Application No. 17155121 dated Oct. 10, 2017.
(Continued)

*Primary Examiner* — Yaovi M Ameh
(74) *Attorney, Agent, or Firm* — Workman Nydegger

(57) ABSTRACT

A liquid ejecting head may include a driver element that ejects liquid in a pressure chamber from a nozzle, a liquid storage chamber that stores liquid to be supplied to the pressure chamber, and a driver IC that drives the driver element. At least a part of the liquid storage chamber overlaps with both the driver element and the driver IC when viewed in plan.

18 Claims, 9 Drawing Sheets

(56) References Cited

U.S. PATENT DOCUMENTS

| | | | | |
|---|---|---|---|---|
| 2013/0120505 | A1* | 5/2013 | Nystrom | B41J 2/161 347/71 |
| 2013/0127956 | A1 | 5/2013 | Watanabe et al. | |
| 2014/0132677 | A1 | 5/2014 | Kondo | |
| 2014/0232796 | A1 | 8/2014 | Kimura et al. | |

FOREIGN PATENT DOCUMENTS

| | | |
|---|---|---|
| JP | 2009-126012 | 6/2009 |
| JP | 2013-028033 | 2/2013 |
| JP | 2013-119166 | 6/2013 |
| JP | 2013-129191 | 7/2013 |
| WO | 2014132615 A1 | 9/2014 |

OTHER PUBLICATIONS

Partial European Search Report issued in EP 17155121 dated Feb. 23, 2018.

* cited by examiner

LIQUID EJECTING HEAD AND LIQUID EJECTING APPARATUS

CROSS-REFERENCE TO RELATED APPLICATIONS

The present application claims priority to Japanese Patent Application No. 2016-023732 filed on Feb. 10, 2016, and Japanese Patent Application No. 2016-184255, filed Sep. 21, 2016, which applications are hereby incorporated by reference in their entirety.

BACKGROUND

1. Technical Field

Embodiments of the present invention relate to systems, apparatus, and methods for ejecting liquid such as ink.

2. Related Art

Liquid ejecting heads for ejecting liquid such as ink from a plurality of nozzles have been proposed. For example, JP-A-2013-129191 discloses a liquid ejecting head for ejecting liquid from nozzles by supplying liquid stored in a common liquid chamber to a plurality of pressure chambers and changing a pressure in each pressure chamber with a pressure generating unit such as a piezoelectric element. In the technique of JP-A-2013-129191, an empty pass-through portion is formed in a unit case constituting the common liquid chamber, and a flexible cable provided with a driver integrated circuit (IC) for driving the pressure generating unit is mounted on the inner side of the empty pass-through portion.

SUMMARY

In the technique of JP-A-2013-129191, however, the empty pass-through portion for mounting the flexible cable needs to be formed in a unit case. This makes is difficult to obtain a sufficient volume for the common liquid chamber. An advantage of embodiments of the invention is to obtain a sufficient volume of space where liquid is stored. In one embodiment, a size of the liquid ejecting head is reduced.

To solve the problems described above, a liquid ejecting head according to one embodiment of the invention includes a driver element that ejects liquid in a pressure chamber from a nozzle, a liquid storage chamber that stores liquid to be supplied to the pressure chamber, and a driver IC that drives the driver element. At least a part of the liquid storage chamber overlaps with both the driver element and the driver IC when viewed in plan. In this example, at least a part of the liquid storage chamber overlaps with both the driving element and the driver IC when viewed in plan. Thus, a sufficient volume for the liquid storage chamber can be advantageously obtained. In comparison, the configuration of JP-A-2013-129191 in which the common liquid chamber does not overlap with any of the piezoelectric element and the driver IC does not obtain a sufficient volume for the liquid storage chamber. Stated differently, embodiments of the invention allow the size of the liquid storage chamber to be increased.

In one embodiment of the invention, the driver IC is disposed between the driver element and the liquid storage chamber. In one aspect, for example, the driver IC is disposed closer to the driver element than in a configuration in which the liquid storage chamber is located between the driver IC and the driver element. Thus, the driver IC and the driver element can be easily connected electrically. Plus, the drive signals are less likely to be distorted due to the shorter distance.

In one embodiment of the invention, the liquid storage chamber includes a first space located at a side opposite to the driver element relative to the driver IC, and a second space located at a side of each of the driver IC and the driver element, and at least a part of the first space overlaps the driver element and the driver IC when viewed in plan. In this aspect, the first space of the liquid storage chamber is located at the side opposite to the driver element relative to the driver IC and overlapping the driver element and the driver IC and the second space located at the side of each of the driver IC and the driver element. Thus, the advantage of easily obtaining a sufficient or larger volume of the liquid storage chamber can be especially significant.

A liquid ejecting head according to one embodiment of the invention includes a protective member including a housing space that houses the driver element. The driver IC is disposed on a surface of the protective member opposite to the housing space. In this aspect, the driver IC is disposed on the surface of the protective member having the housing space that houses the driver element. That is, the driver IC is disposed near the driver element. Accordingly, as compared to a configuration in which the driver IC is disposed on a wiring board mounted on the protective member, for example, a path length from the driver IC to the driver element can be reduced so that signal distortions caused by a resistance component and a capacitance component of the path can be reduced.

In a liquid ejecting head according to one embodiment of the invention, the driver element includes a plurality of driver elements. The liquid ejecting head further includes a wire member disposed at an end of the protective member in a direction in which the driver elements are arranged, and the wire member is electrically connected to the driver IC. In the above aspect, the wire member is disposed at the end of the protective member in the direction in which the driver elements are arranged. Thus, it is unnecessary to provide space for a wire member at some location in the arrangement of the driver elements. Accordingly, the above-described advantage of easily obtaining a sufficient volume of the liquid storage chamber is especially significant.

A liquid ejecting head according to one embodiment of the invention further includes a first flexible damping body that is disposed on a first surface closer to the driver element than to the driver IC and constitutes a wall surface of the liquid storage chamber. In this aspect, the first damping body disposed on the first surface closer to the driver element than to the driver IC absorbs a pressure variation in the liquid storage chamber. Thus, the possibility that the pressure variation in the liquid storage chamber propagates to the pressure chamber to affect ink injection characteristics (e.g., an ejection amount, an ejection speed, and an ejection direction) can be reduced.

A liquid ejecting head according to one embodiment of the invention further includes a second flexible damping body that is disposed on a second surface at a side of the driver element opposite to the driver IC and constitutes a wall surface of the liquid storage chamber. In this aspect, the second damping body disposed on the second surface opposite to the driver element relative to the driver IC absorbs a pressure variation in the liquid storage chamber. Thus, the possibility that the pressure variation in the liquid storage chamber propagates to the pressure chamber to affect ink injection characteristics can be reduced. In the configuration in which both the first damping body and the second damping body are provided, the advantage of reducing the pressure variation in the liquid storage chamber is especially significant.

A liquid ejecting head according to one embodiment of the invention includes a driver element that causes liquid in a pressure chamber to be ejected from a nozzle, a liquid storage chamber that stores liquid to be supplied to the pressure chamber, and a driver IC that drives the driver element. At least a part of the liquid storage chamber overlaps both the nozzle and the driver IC when viewed in plan. In this aspect, because at least a part of the liquid storage chamber overlaps both the nozzle and the driver IC when viewed in plan, a sufficient or larger volume of the liquid storage chamber can be obtained advantageously, as compared to the configuration of JP-A-2013-129191.

A liquid ejecting head according to one embodiment of the invention includes a driver element that causes liquid in a pressure chamber to be ejected from a nozzle, a liquid storage chamber that stores the liquid to be supplied to the pressure chamber, and a driver IC that drives the driver element. At least a part of the liquid storage chamber overlaps both the pressure chamber and the driver IC when viewed in plan. In this aspect, because at least a part of the liquid storage chamber overlaps both the pressure chamber and the driver IC when viewed in plan, a sufficient or larger volume of the liquid storage chamber can be obtained advantageously, as compared to the configuration of JP-A-2013-129191.

A liquid ejecting apparatus according to one embodiment of the invention includes the liquid ejecting head of any one of the aspects described above. Although an example of the liquid ejecting apparatus is a printing apparatus that ejects ink, applications of a liquid ejecting apparatus according to the invention is not limited to printing.

BRIEF DESCRIPTION OF THE DRAWINGS

Embodiments of the invention will be described with reference to the accompanying drawings, wherein like numbers reference like elements.

DESCRIPTION OF EXEMPLARY EMBODIMENTS

Figure 1:
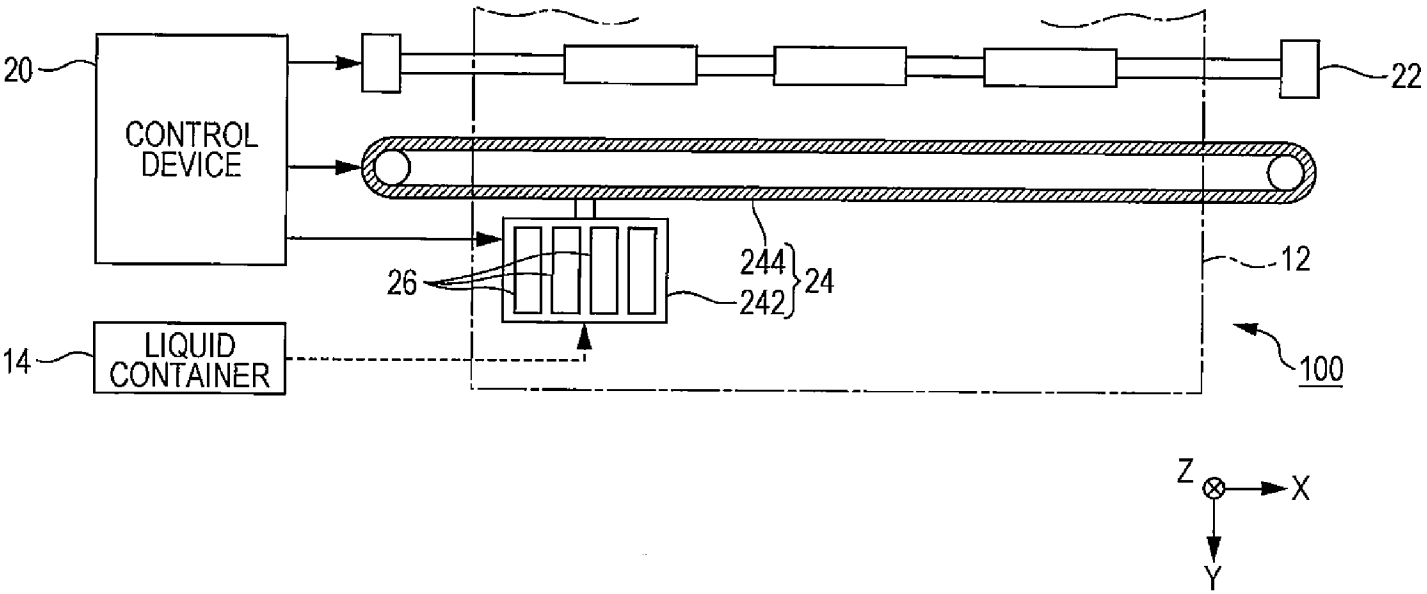
FIG. 1 illustrates a configuration of a liquid ejecting apparatus according to a first embodiment of the invention.

FIG. 1 illustrates a configuration of a liquid ejecting apparatus 100 according to a first embodiment of the invention. The liquid ejecting apparatus 100 is an ink jet apparatus that ejects ink, which is an example of liquid, to a medium 12. The medium 12 is typically printing paper, but any printing target such as a resin film or a fabric can be used as the medium 12. As exemplified in FIG. 1, a liquid container 14 for storing ink therein is fixed to the liquid ejecting apparatus 100. The liquid container 14 may be, for example, a cartridge that is removably attached to the liquid ejecting apparatus 100, a bag-shaped ink pack that is made of a flexible film and removably attached to the liquid ejecting apparatus 100, or an ink tank that can be filled with ink and is removably attached to the liquid ejecting apparatus 100. The liquid container 14 may store a plurality of types of ink with different colors. For example, the liquid container 14 may include multiple cartridges or the like.

As exemplified in FIG. 1, the liquid ejecting apparatus 100 includes a control device 20, a conveyance mechanism 22, a movement mechanism 24, and a plurality of liquid ejecting heads 26. The control device 20 includes a processing circuit such as a central processing unit (CPU) or a field programmable gate array (FPGA) and a memory circuit such as a semiconductor memory. The control device 20 controls all elements of the liquid ejecting apparatus 100. The conveyance mechanism 22 conveys the medium 12 in a Y direction under control by the control device 20.

The movement mechanism 24 reciprocates the liquid ejecting heads 26 in an X direction under control by the control device 20. The X direction is a direction intersecting (typically orthogonal to) the Y direction in which the medium 12 is conveyed. The movement mechanism 24 includes a substantially box-shaped conveyer (carriage) 242 for housing the liquid ejecting heads 26 and an endless belt 244 to which the conveyer 242 is fixed. The liquid container 14 can be mounted on the conveyor 242 together with the liquid ejecting heads 26.

Each of the liquid ejecting heads 26 ejects ink supplied from the liquid container 14 to the medium 12 through a plurality of nozzles (ejection openings) under control by the control device 20. In parallel with conveyance of the medium 12 by the conveyance mechanism 22 and repetitive reciprocation of the conveyer 242, the liquid ejecting heads 26 eject ink onto the medium 12 so that a desired image is formed on a surface of the medium 12. A direction orthogonal to an X-Y plane (e.g., a plane parallel to the surface of the medium 12) is hereinafter referred to as a Z direction. The Z direction corresponds to a direction of ink ejection by the liquid ejecting heads 26 (typically a vertical direction).

Figure 2:
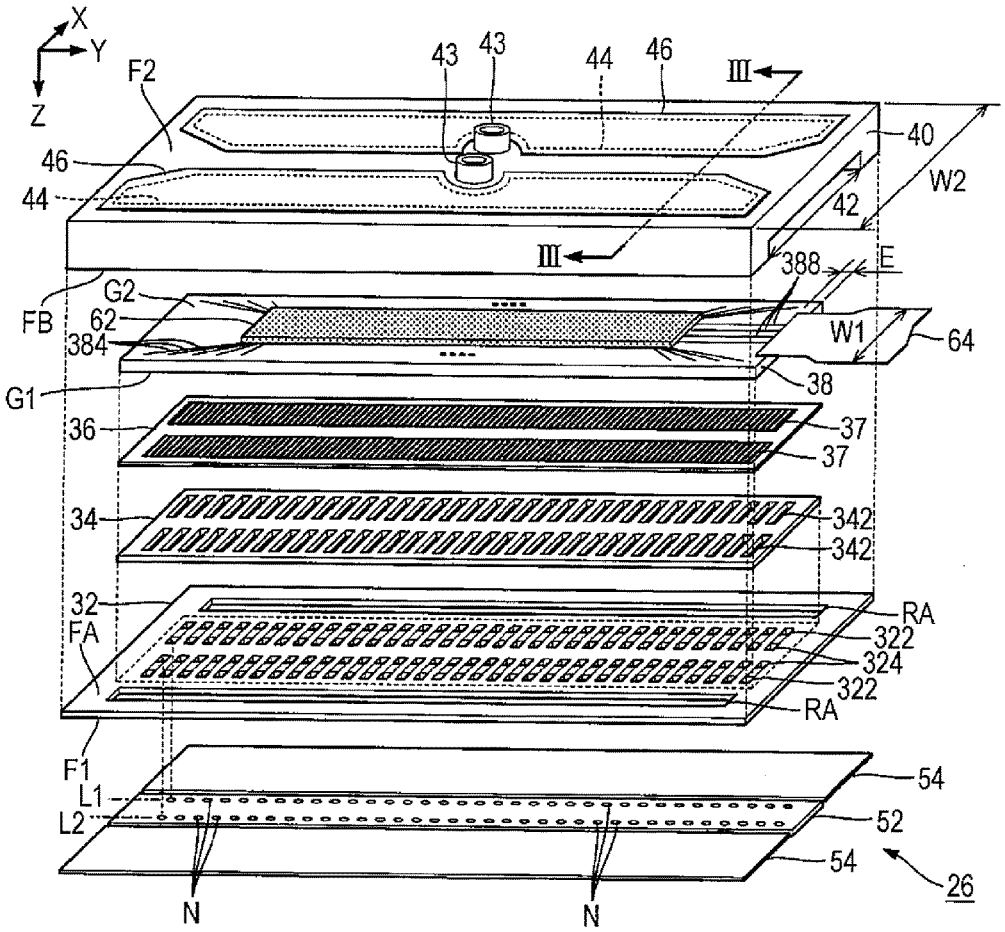
FIG. 2 is a disassembled perspective view of a liquid ejecting head.
Figure 3:
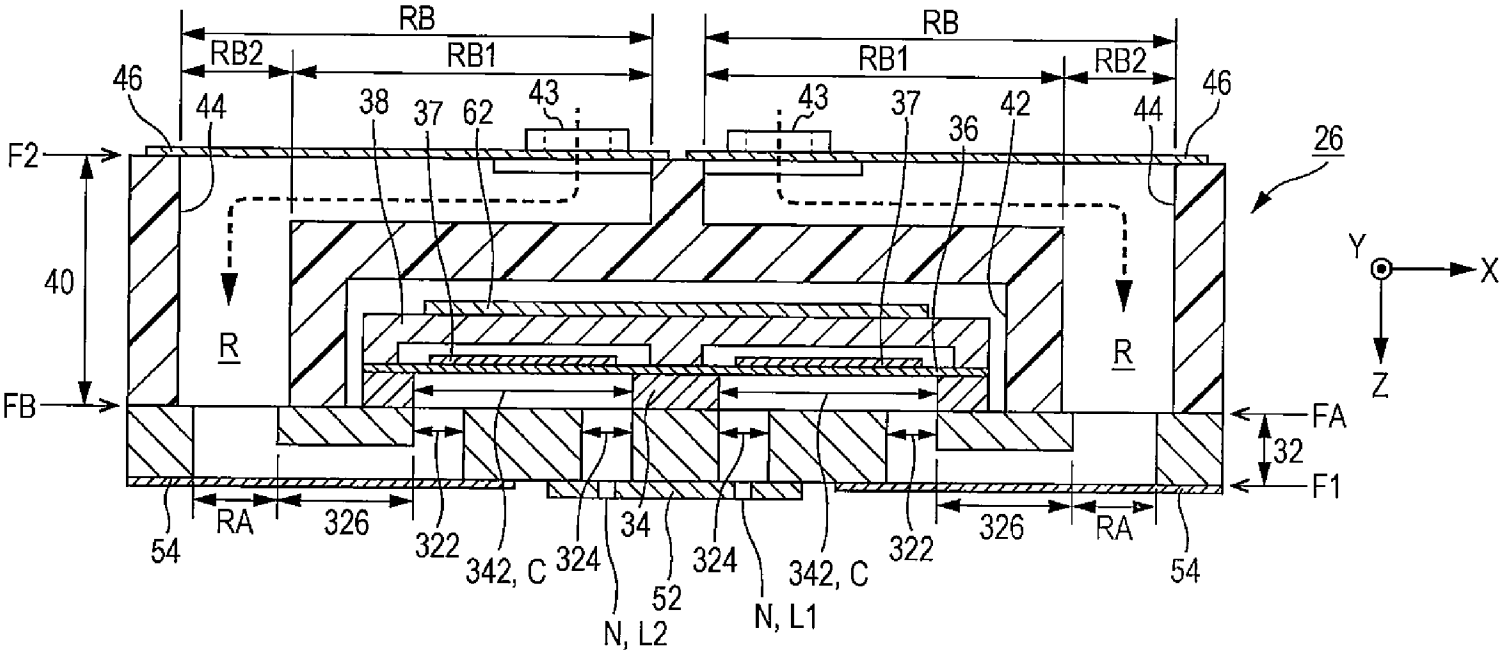
FIG. 3 is a cross-sectional view of the liquid ejecting head (the cross-sectional view is taken along line III-III in FIG. 2).

FIG. 2 is a disassembled perspective view of any one of the liquid ejecting heads 26. FIG. 3 is a cross-sectional view taken along line III-III in FIG. 2. As exemplified in FIG. 2, each of the liquid ejecting heads 26 includes a plurality of nozzles N arranged along the Y direction. The nozzles N according to the first embodiment are divided into a first line L1 and a second line L2. Although the position of the nozzles N in the Y direction can be made different between the first line L1 and the second line L2 (i.e., a zigzag or staggered arrangement), a configuration in which the position of the first line L1 of the nozzles N in the Y direction coincides with the position of the second line L2 of the nozzles N in the Y direction is illustrated in FIG. 3 for convenience. As understood from FIG. 2, each of the liquid ejecting heads 26 according to the first embodiment has a configuration in which elements concerning the first line L1 of the nozzles N and elements concerning the second line L2 of the nozzles N are arranged substantially symmetric about a line.

As exemplified in FIGS. 2 and 3, each of the liquid ejecting heads 26 according to the first embodiment includes a channel substrate 32. The channel substrate 32 is a plate-like member having a first surface F1 and a joint surface FA. The first surface F1 is a surface at a positive side in the Z direction (the first surface is towards or faces the medium 12). The joint surface FA is a surface at a side opposite to the first surface F1 (at a negative side in the Z direction). A pressure chamber substrate 34, a vibration part 36, a plurality of piezoelectric elements 37, a protective member 38, and a housing 40 are disposed on or above the joint surface FA of the channel substrate 32. A nozzle plate 52 and a damping body 54 are disposed on the first surface F1. Generally, elements of each of the liquid ejecting heads 26 are plate-like members elongated in the Y direction in a manner similar to that of the channel substrate 32, and are bonded together by using an adhesive, for example. The elements may also be arranged in the Z direction in which the channel substrate 32, the pressure chamber substrate 34, the protective member 38, and the nozzle plate 52 are stacked.

The nozzle plate 52 is a plate-like member having a plurality of nozzles N, and is disposed on, for example, the first surface F1 of the channel substrate 32 using an adhesive, for example. The nozzles N are through holes through which ink passes or through which ink is ejected. The nozzle plate 52 according to the first embodiment is prepared by processing a single crystal substrate of silicon (Si) with a semiconductor fabrication technique (e.g., etching). It should be noted that the nozzle plate 52 may be prepared by using any known material with any known method.

The channel substrate 32 is a plate-like member for forming a channel for ink or in which the ink flows. As exemplified in FIGS. 2 and 3, the channel substrate 32 according to the first embodiment has a space RA, a plurality of supply channels 322, and a plurality of communication channels 324, for each of the first line L1 and the second line L2. The space RA is an opening elongated in the Y direction when viewed in plan (i.e., when viewed in the Z direction). The supply channels 322 and the communication channels 324 are through holes formed for the individual nozzles N. The supply channels 322 are arranged in the Y direction. Similarly, the communication channels 324 are arranged in the Y direction. As exemplified in FIG. 3, the first surface F1 of the channel substrate 32 has an intermediate channel 326 extending across the supply channels 322. The intermediate channel 326 is a channel for allowing the space RA to communicate with the supply channels 322. On the other hand, the communication channels 324 communicate with the nozzles N. In one example, the thickness of the channel substrate at the intermediate channels 326 is less than a thickness of the channel substrate 32 at other locations. The intermediate channels 326 are not through holes that pass through the channel substrate 32. Rather, the intermediate channels 326 are formed in the channel substrate 32 to connect the space RA with the supply channels 322 as previously stated.

As exemplified in FIGS. 2 and 3, the pressure chamber substrate 34 is a plate-like member in which a plurality of openings 342 arranged in the Y direction are formed for each of the first line L1 and the second line L2, and is disposed on the joint surface FA of the channel substrate 32 by using an adhesive, for example. The openings 342 are through holes formed for the individual nozzles N and elongated in the X direction when viewed in plan. In a manner similar to that of the nozzle plate 52 described above, the channel substrate 32 and the pressure chamber substrate 34 are prepared by processing a single crystal substrate of silicon (Si) with a semiconductor fabrication technique, for example. It should be noted that each of the channel substrate 32 and the pressure chamber substrate 34 may be prepared by using any known material with any known method.

As exemplified in FIGS. 2 and 3, the vibration part 36 is disposed on or adhered to a surface of the pressure chamber substrate 34 opposite to the channel substrate 32. The vibration part 36 according to the first embodiment is a plate-like member (vibration plate) that can elastically vibrate. The pressure chamber substrate 34 and the vibration part 36 may be formed as one unit by selectively removing a part, in the plate thickness direction, of a region of a plate-like member having a predetermined thickness corresponding to the openings 342. Alternatively, the pressure chamber substrate 34 and the vibration part 36 may be formed separately and adhered together during the manufacturing process.

As understood from FIG. 3, the joint surface FA of the channel substrate 32 and the vibration part 36 face each other with a predetermined interval inside each of the openings 342. Space between the joint surface FA of the channel substrate 32 and the vibration part 36 inside each of the openings 342 serves as a pressure chamber C for applying a pressure to ink filling the space or filling the pressure chamber. The pressure chamber C is, for example, a space whose longitudinal direction is the X direction and whose lateral direction is the Y direction. The pressure chamber C is formed for each of the nozzles N. The multiple pressure chambers C are arranged in the Y direction for each of the first line L1 and the second line L2. As understood from FIG. 3, any one pressure chamber C communicates with the space RA through the supply channels 322 and the intermediate channel 326, and communicates with the nozzles N through the communication channels 324. A predetermined channel resistance may be added by forming narrowing channels each having a narrowing channel width in the openings 342.

As exemplified in FIGS. 2 and 3, a plurality of piezoelectric elements 37 corresponding to different nozzles N are disposed on a surface of the vibration part 36 opposite to the pressure chambers C, for each of the first line L1 and the second line L2. Each of the piezoelectric elements 37 is a passive element that deforms with a supply of a driving signal. The piezoelectric elements 37 are arranged in the Y direction in correspondence with the individual pressure chambers C.

Figure 4:
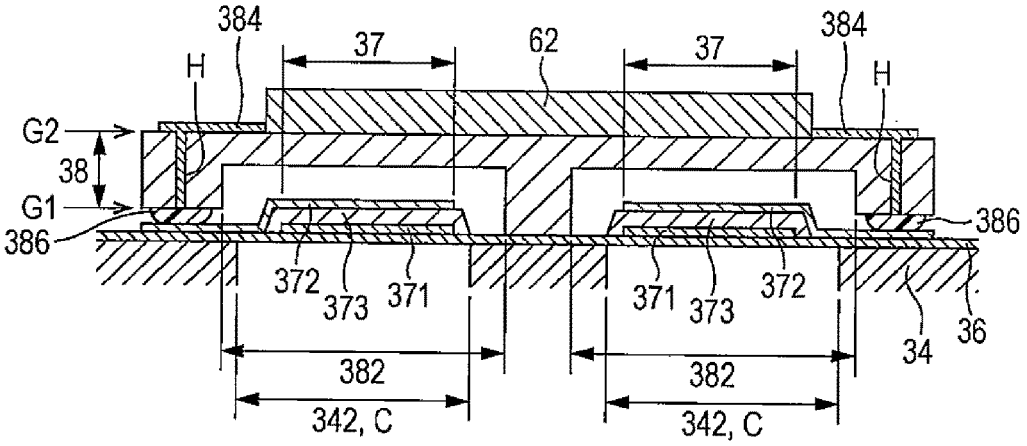
FIG. 4 is an enlarged cross-sectional view of the vicinity of a piezoelectric element.

FIG. 4 is an enlarged cross-sectional view of the vicinity of the piezoelectric elements 37. As exemplified in FIG. 4, each of the piezoelectric elements 37 is a stacked body in which a piezoelectric layer 373 is interposed between a first electrode 371 and a second electrode 372 that are opposed to each other. When the vibration part 36 vibrates in conjunction with deformation of the piezoelectric elements 37, a pressure in the pressure chambers C varies so that ink filling the pressure chambers C is ejected through the communication channels 324 and the nozzles N. Each of the piezoelectric elements 37 is defined as a portion where the first electrode 371, the second electrode 372, and the piezoelectric layer 373 overlap one another when viewed in plan. Alternatively, the piezoelectric elements 37 may be defined as a portion that deforms with a supply of a driving signal (i.e., an active portion for vibrating the vibration part 36).

The protective member 38 illustrated in FIGS. 2 and 3 is a plate-like member for protecting the piezoelectric elements 37, and is disposed on a surface of the vibration part 36 (or a surface of the pressure chamber substrate 34). Although the protective member 38 may be made of any material with any method, the protective member 38 can be prepared by processing a single crystal substrate of silicon (Si) with a semiconductor fabrication technique, in a manner similar to those of the channel substrate 32 and the pressure chamber substrate 34.

As exemplified in FIG. 4, a housing space 382 for housing the piezoelectric elements 37 is formed in a surface (hereinafter referred to as a "joint surface") G1 of the protective member 38 facing the vibration part 36, for each of the first line L1 and the second line L2. The housing space 382 is a space recessed in the joint surface G1, and has a shape elongated in the Y direction along the arrangement of the piezoelectric elements 37. A driver IC 62 is disposed on a surface (hereinafter referred to as a "mount surface") G2 of the protective member 38 opposite to the housing space 382. The driver IC 62 is a substantially rectangular IC chip on which a driving circuit for driving each of the piezoelectric elements 37 by generating and supplying a driving signal under control by the control device 20 is mounted. As understood from FIGS. 3 and 4, at least some of the piezoelectric elements 37 of each of the liquid ejecting heads 26 overlap the driver IC 62 when viewed in plan. As exemplified in FIGS. 3 and 4, the driver IC 62 overlaps both the piezoelectric elements 37 corresponding to the first line L1 of the nozzles N and the piezoelectric elements 37 corresponding to the second line L2 of the nozzles N, when viewed in plan. That is, the driver IC 62 is disposed across both the first line L1 of the nozzles N and the second line L2 of the nozzles N in the X direction.

A wire 384 connected to an output terminal of the driver IC 62 is formed on the mount surface G2 of the protective member 38 for each of the piezoelectric elements 37. Each wire 384 is electrically connected to a connection terminal 386 on the joint surface G1 through a via hole (contact hole) H penetrating the protective member 38. The connection terminal 386 on the joint surface G1 is electrically connected to the second electrode 372 of the piezoelectric element 37. For example, the connection terminal 386 is preferably a known resin core bump formed by coating a projection of a resin material on the joint surface G1 with a conductive material. A driving signal output from the output terminal of the driver IC 62 is supplied to each of the piezoelectric elements 37 through the wire 384, the via hole H, and the connection terminal 386.

As exemplified in FIG. 2, a plurality of wires 388 connected to an input terminal of the driver IC 62 are formed on the mount surface G2 of the protective member 38. The wires 388 extend to a region E at an end in the Y direction (i.e., in the direction in which the piezoelectric elements 37 are arranged) of the mount surface G2 of the protective member 38. A wire member 64 is joined to the region E of the mount surface G2. The wire member 64 is a mount component provided with a plurality of wires (not shown) for electrically connecting the control device 20 to the driver IC 62. For example, the wire member 64 is preferably a flexible wiring board such as a flexible printed circuit (FPC) or a flexible flat cable (FFC). As understood from the foregoing description, the protective member 38 according to the first embodiment also serves as a wiring board provided with wires (384, 388) for transmitting a driving signal. The wiring board for use in mounting the driver IC 62 and forming wires may be provided separately from the protective member 38.

The housing 40 exemplified in FIGS. 2 and 3 is a case for storing ink to be supplied to a plurality of pressure chambers C (and further nozzles N). A surface (hereinafter referred to as a "joint surface") FB of the housing 40 at a positive side in the Z direction is fixed to the joint surface FA of the channel substrate 32 by using, for example, an adhesive. In one example, the more than one substrate may be fixed or bonded to the joint surface FA. In this example the surface FB of the housing 40 and the pressure chamber substrate 34 are bonded or fixed to the joint surface FA.

As exemplified in FIGS. 2 and 3, the joint surface FB of the housing 40 has a grooved recess 42 extending in the Y direction. The protective member 38 and the driver IC 62 are housed in the recess 42. The wire member 64 joined to the region E of the protective member 38 extends in the Y direction to pass through the inside of the recess 42. As understood from FIG. 2, the wire member 64 has a width W1 (a maximum value of a dimension in the X direction) smaller than a width W2 of the housing 40 (i.e., W1<W2).

The housing 40 according to the first embodiment is made of a material different from those for the channel substrate 32 and the pressure chamber substrate 34. For example, the housing 40 may be formed by an injection molding of a resin material, for example. It should be noted that the housing 40 may be prepared by using any known material with any known method. Examples of the material for the housing 40 include synthetic fibers such as polyparaphenylene benzobisoxazole (ZYLON, registered trademark) and a resin material such as a liquid crystal polymer.

As exemplified in FIG. 3, the housing 40 according to the first embodiment has a space RB for each of the first line L1 and the second line L2. The space RB of the housing 40 communicates with the space RA of the channel substrate 32. A space constituted by the space RA and the space RB serves as a liquid storage chamber (reservoir) R for storing ink to be supplied to the pressure chamber C. The liquid storage chamber R is a common liquid chamber for a plurality of nozzles N. A surface (hereinafter referred to as a second surface") F2 of the housing 40 opposite to the channel substrate 32 has inlets 43 each for introducing ink supplied from the liquid container 14 to the liquid storage chamber R. One of the inlets 43 corresponds to one of the first line L1 or the second line L2, and the other inlet 43 corresponds to the other one of the first line L1 or the second line L2.

As exemplified in FIG. 3, the space RB of the housing 40 includes a first space RB1 and a second space RB2. Each of the first space RB1 and the second space RB2 is elongated in the Y direction. The first space RB1 communicates with the inlet 43. The second space RB2 is located downstream of the first space RB1, and communicates with the space RA of the channel substrate 32. When viewed from the front in the Z direction, the recess 42 for housing the protective member 38 and the driver IC 62 is located between the second space RB2 corresponding to the first line L1 and the second space RB2 corresponding to the second line L2. Thus, the second space RB2 is located at a side of the piezoelectric elements 37, the protective member 38, and the driver IC 62 (at a positive or negative side in the X direction). As exemplified above, in the first embodiment, the liquid storage chamber R (space RB of the housing 40) includes the first space RB1 and the second space RB2. Thus, as compared to a case where the space RB is constituted only by one of the first space RB1 or the second space RB2, the volume of the liquid storage chamber R can be increased.

As indicated by broken arrows in FIG. 3, ink supplied from the liquid container 14 to each inlet 43 in the positive direction of the Z direction flows in a direction substantially in parallel with an X-Y plane (e.g., a horizontal direction, the X direction) in the first space RB1 of the liquid storage chamber R to flow into the second space RB2, and flows in the positive direction of the Z direction (e.g., downward in the vertical direction) in the second space RB2 to reach the space RA of the channel substrate 32. Ink stored in the liquid storage chamber R flows in the X direction in the intermediate channel 326, branches into a plurality of supply channels 322 from the intermediate channel 326, flows in the negative direction of the Z direction, and is supplied to the pressure chamber C in parallel so that the pressure chamber C is filled with the ink. Ink filling the pressure chambers C flows in the Z direction in the communication channels 324, and is ejected through the nozzles N.

As exemplified above, each of the liquid ejecting heads 26 according to the first embodiment includes the first surface F1 and the second surface F2. The piezoelectric elements 37, the protective member 38, and the driver IC 62 are disposed between the first surface F1 and the second surface F2. The first surface F1 is disposed closer to the piezoelectric elements 37 than to the driver IC 62. The second surface F2 is disposed at the side opposite to the piezoelectric elements 37 relative to the driver IC 62. The second surface F2 has openings 44 corresponding to the space RB (the first space RB1 and the second space RB2), as well as the inlets 43 described above.

As exemplified in FIG. 2, the damping body 54 (an example of a first damping body) is disposed on the first surface F1. The damping body 54 is a flexible film (compliance substrate) that absorbs a pressure variation of ink in the liquid storage chamber R. As exemplified in FIG. 3, the damping body 54 is disposed on the first surface F1 of the channel substrate 32 to close the space RA of the channel substrate 32, the intermediate channel 326, and the supply channels 322, and constitutes a wall surface (specifically a bottom surface) of the liquid storage chamber R.

A damping body 46 (an example of a second damping body) is disposed on the second surface F2 of the housing 40. In a manner similar to the damping body 54, the damping body 46 is a flexible film that absorbs a pressure variation of ink in the liquid storage chamber R, is disposed on the second surface F2 to close the openings 44, and constitutes a wall surface (specifically a celling surface) of the liquid storage chamber R. Since a sufficiently large area can be easily obtained for the second surface F2, the first embodiment in which the damping body 46 is disposed on the second surface F2 has an advantage of more effectively absorbing a pressure variation in the liquid storage chamber R than in a configuration in which only the damping body 54 is disposed.

As exemplified in FIG. 3, at least a part of the liquid storage chamber R according to the first embodiment overlaps both the piezoelectric elements 37 and the driver IC 62 when viewed in plan. Specifically, a part of the first space RB1 of the liquid storage chamber R located at a side opposite to the piezoelectric elements 37 relative to the driver IC 62 overlaps the piezoelectric elements 37 and the driver IC 62 when viewed in plan. That is, a part of the liquid storage chamber R overlapping the piezoelectric elements 37 when viewed in plan also overlaps the driver IC 62 when viewed in plan. In other words, the first space RB1 extends from the second space RB2 in the X direction to overlap the piezoelectric elements 37 and the driver IC 62. In one example, the first space RB1 overlaps the piezoelectric elements 37 and the driver IC 62 for both the line L1 and the line L2.

The configuration exemplified in FIG. 3 can be, in other words, a configuration in which at least a part of the liquid storage chamber R overlaps both the driver IC 62 and the nozzles N when viewed in plan. That is, a part of the liquid storage chamber R overlapping the driver IC 62 when viewed in plan also overlaps the nozzles N when viewed in plan. As understood from FIG. 3, focusing on a positional relationship among elements along the Z direction, the driver IC 62 is located between the liquid storage chamber R and the nozzles N. The configuration exemplified in FIG. 3 can be, in other words, a configuration in which at least a part of the liquid storage chamber R overlaps both the driver IC 62 and the pressure chamber C when viewed in plan. That is, a part of the liquid storage chamber R overlapping the driver IC 62 when viewed in plan also overlaps the pressure chamber C when viewed in plan. As understood from FIG. 3, focusing on a positional relationship among elements along the Z direction, the driver IC 62 is located between the liquid storage chamber R and the pressure chamber C.

Figure 5:
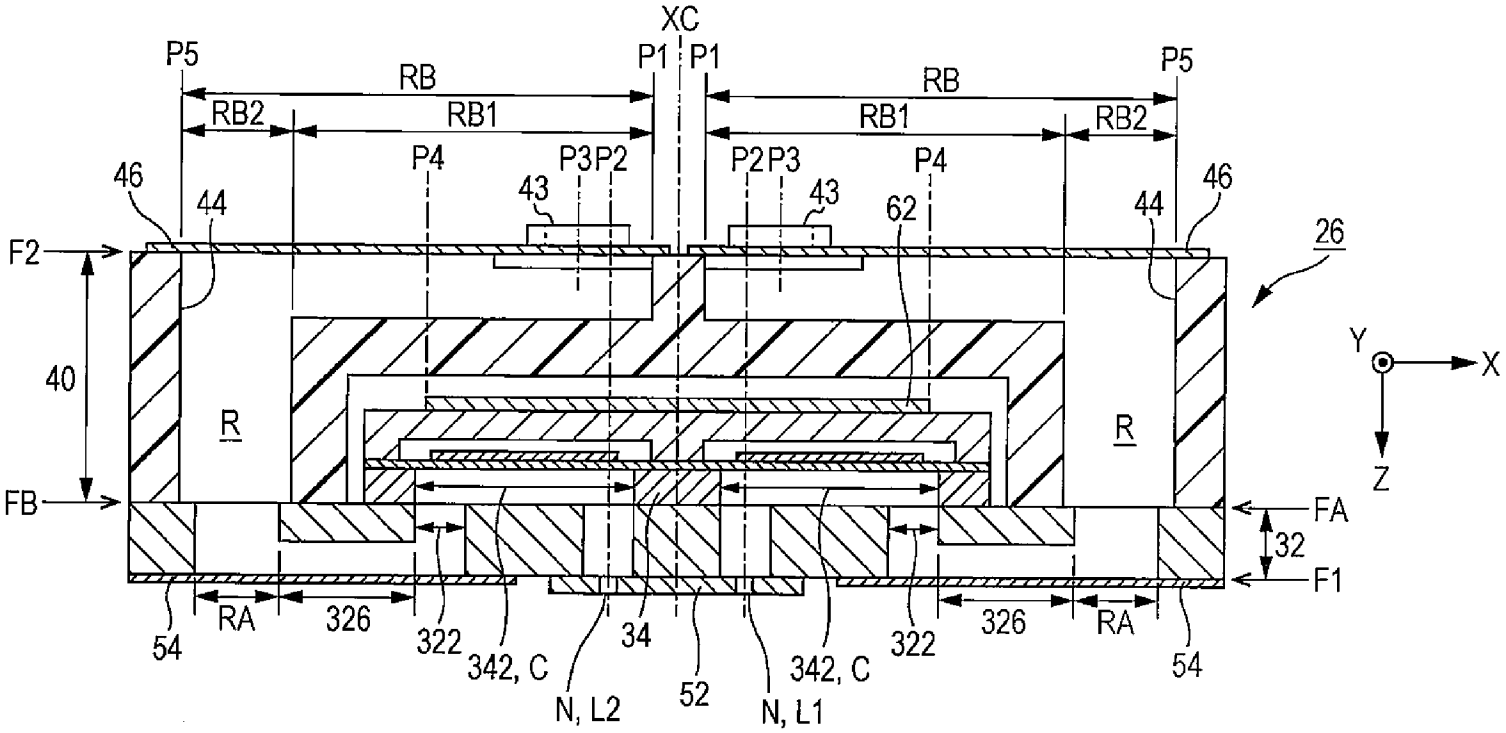
FIG. 5 is a view for describing a positional relationship between a median and elements of the liquid ejecting head.

FIG. 5 is a cross-sectional view focusing on a relationship among the positions (P1 to P5) in the X direction of the elements with respect to a median XC (that is not limited to a center of each liquid ejecting head 26 and may be a center line in a substantially line symmetric configuration) extending along the Z direction from a midpoint of the liquid ejecting head 26 in the X direction. The position P1 in FIG. 5 is a position at an end of the liquid storage chamber R near the median XC. The position P5 is a position at an end of the liquid storage chamber R opposite to the median XC. In one example, the position P1 is closest to the median XC and the position P5 is furthest from the median XC. The position P2 is a position at a center axis of each nozzle N in the X direction. The position P3 is a position at a center axis of each inlet 43 in the X direction. The position P4 is a position at an end of the driver IC 62. As understood from FIG. 5, in the first embodiment, the end P1 of the liquid storage chamber R near the median XC, the center axis P2 of the nozzle N, the center axis P3 of the inlet 43, the end P4 of the driver IC 62, and the end P5 of the liquid storage chamber R opposite to the median XC are arranged in this order in the X direction from a side close to the median XC.

As described above, in the first embodiment, at least a part of the liquid storage chamber R overlaps the piezoelectric elements 37 and the driver IC 62 when viewed in plan. Thus, as compared to the configuration of JP-A-2013-129191 in which the common liquid chamber does not overlap any of the piezoelectric element and the driver IC, a sufficient volume of the liquid storage chamber R can be easily obtained advantageously along with a reduction in size of the liquid ejecting heads 26. In particular, in the first embodiment, the liquid storage chamber R includes the first space RB1 located at a side opposite to the piezoelectric elements 37 relative to the driver IC 62 and overlapping the piezoelectric elements 37 and the driver IC 62, and also includes the second space RB2 located at the side of the driver IC 62 and the piezoelectric elements 37. Thus, the above-described advantage of easily obtaining a sufficient volume of the liquid storage chamber R is especially significant. In one example, the space RB1 is available because the wire member 64 exits through a side of the housing 40 in the Y direction rather than through a top of the housing 40 in a Z direction.

In addition, the driver IC 62 is disposed on the mount surface G2 of the protective member 38 having the housing spaces 382 housing the piezoelectric elements 37. That is, the driver IC 62 is disposed near the piezoelectric elements 37. Accordingly, as compared to a configuration in which the driver IC 62 is mounted on a wiring board fixed to the protective member 38, for example, the path length from the driver IC 62 to the piezoelectric elements 37 is reduced so that a signal distortion caused by a resistance component and a capacitance component of the path can be reduced.

In the first embodiment, since the wire member 64 is disposed in the region E at an end in the Y direction of the protective member 38 where the piezoelectric elements 37 are arranged, it is unnecessary to provide space for wire member 64 at some location in the arrangement of the piezoelectric elements 37. Thus, the above-described advantage of easily obtaining a sufficient volume of the liquid storage chamber R is especially significant.

In the first embodiment, because the damping body 54 and the damping body 46 absorb a pressure variation in the liquid storage chamber R, the possibility that the pressure variation in the liquid storage chamber R propagates to the pressure chambers C to affect ink injection characteristics (e.g., an ejection amount, an ejection speed, and an ejection direction) can be reduced. In the first embodiment, in particular, because the damping body 54 is disposed on the first surface F1 and the damping body 46 is disposed on the second surface F2, the advantage of reducing the pressure variation in the liquid storage chamber R is especially significant. An opening may optionally be formed in a side surface of the housing 40 so that a damping body is disposed therein.

The positions (P1 to P5) of the elements of the liquid ejecting head 26 are not limited to those in the example of FIG. 5. For example, as exemplified in FIG. 6, the relationship between the center axis P3 of the inlet 43 and the end P4 of the driver IC 62 may be inverted from the configuration of FIG. 5. That is, in the configuration of FIG. 6, the end P1 of the liquid storage chamber R near the median XC, the center axis P2 of the nozzle N, the end P4 of the driver IC 62, the center axis P3 of the inlet 43, and the end P5 of the liquid storage chamber R opposite to the median XC are arranged in this order in the X direction from a side close to the median XC. In other words, the inlet 43 may be placed at different positions relative to the median XC. In one embodiment, the inlet 43 if placed over the space RB1.

Figure 6:
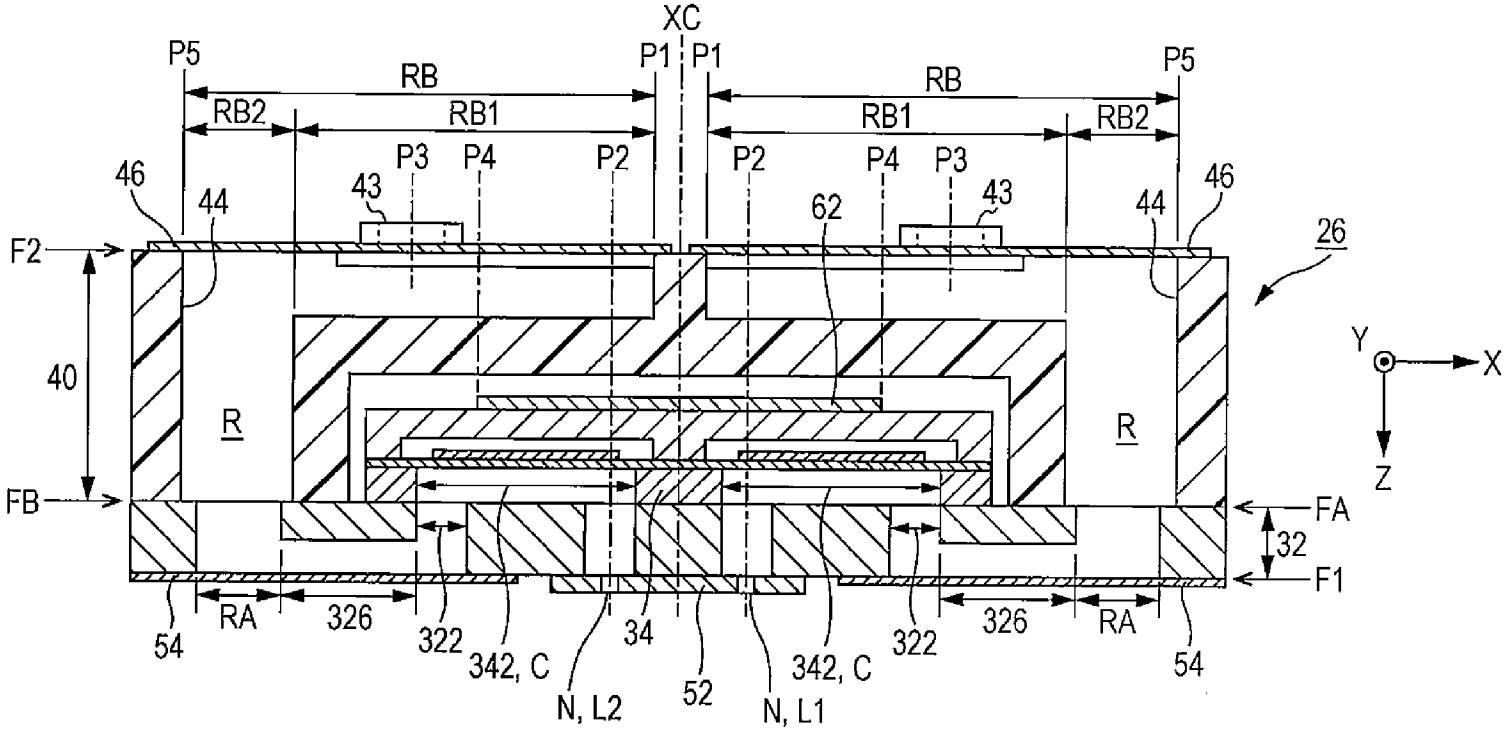
FIG. 6 is a view for describing a positional relationship between a median and each element of the liquid ejecting head.
Figure 7:
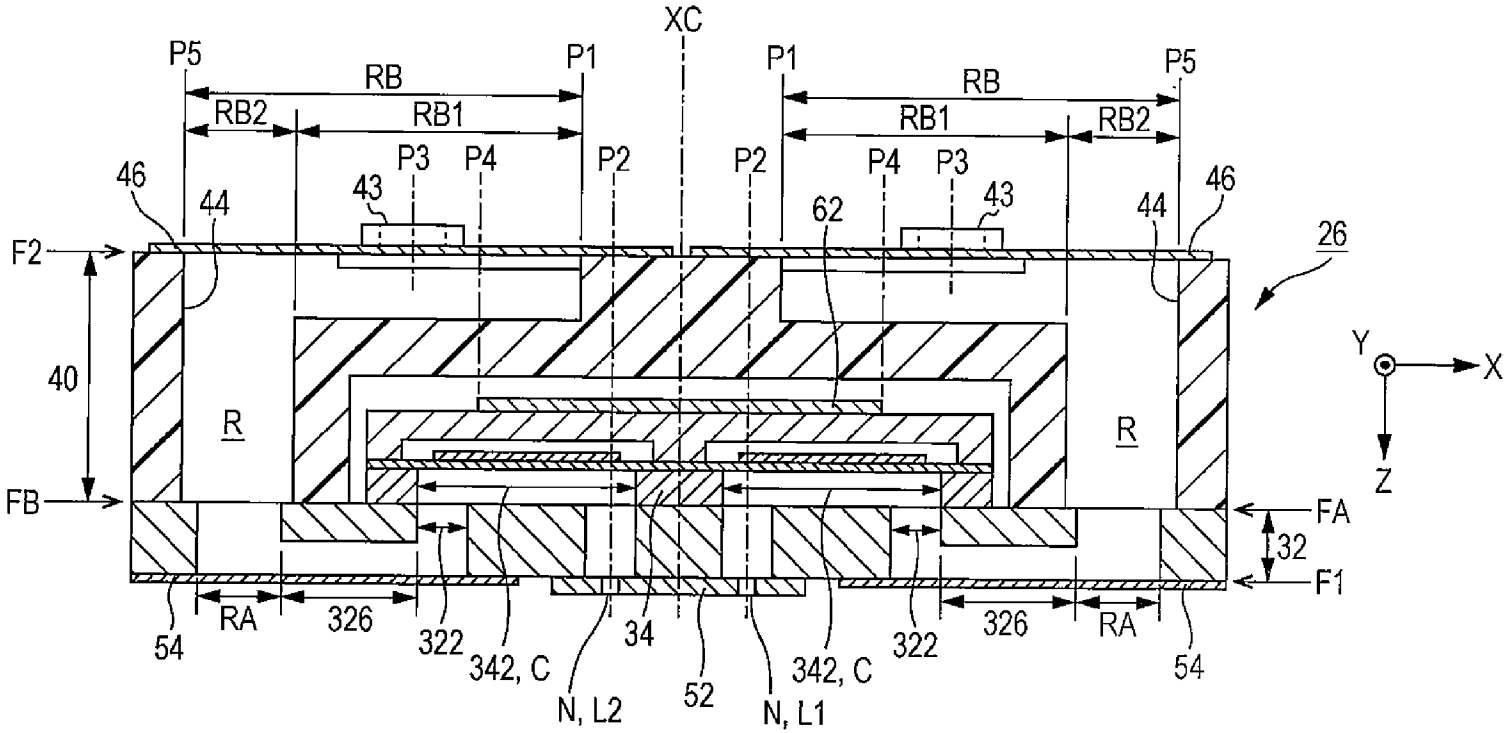
FIG. 7 is a view for describing a positional relationship between a median and each element of the liquid ejecting head.

As exemplified in FIG. 7, the relationship between the end P1 of the liquid storage chamber R near the median XC and the center axis P2 of the nozzle N may be inverted from the configuration of FIG. 6. That is, in the configuration of FIG. 7, the center axis P2 of the nozzle N, the end P1 of the liquid storage chamber R near the median XC, the end P4 of the driver IC 62, the center axis P3 of the inlet 43, and the end P5 of the liquid storage chamber R opposite to the median XC are arranged in this order in the X direction from a side close to the median XC. In the configuration of FIG. 7, in a manner similar to the configuration of FIG. 5, the center axis P3 of the inlet 43 may be disposed near the median XC relative to the end P4 of the driver IC 62. That is, the center axis P2 of the nozzle N, the end P1 of the liquid storage chamber R near the median XC, the center axis P3 of the inlet 43, the end P4 of the driver IC 62, and the end P5 of the liquid storage chamber R opposite to the median XC are arranged in this order in the X direction from a side close to the median XC.

In some examples, one or more of the positions P1, P2, P3, and P4 may overlap with one or more of the driver IC 62, the space RB1, and the piezoelectric elements 37.

A second embodiment according to the present invention will now be described. In the following embodiments, elements whose effects and functions are similar to those of the first embodiment are denoted by the same reference numerals as those used in the first embodiment, and detailed description thereof will be omitted as necessary.

Figure 8:
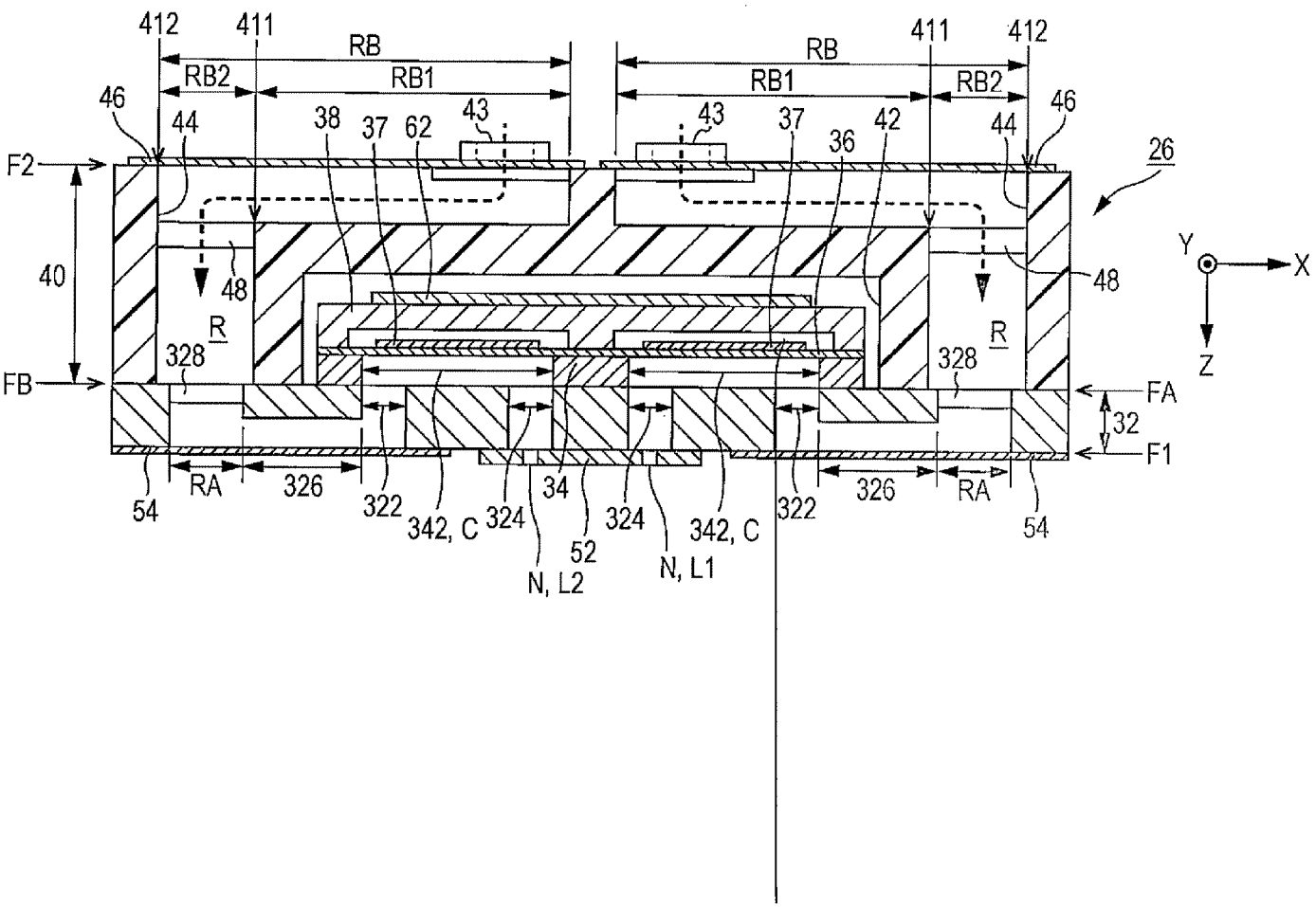
FIG. 8 is a cross-sectional view of a liquid ejecting head according to a second embodiment.

FIG. 8 is a cross-sectional view of a liquid ejecting head 26 according to the second embodiment (a cross-sectional view similar to that of FIG. 3). As exemplified in FIG. 8, a beam-shaped portion 48 is disposed in a housing 40 according to the second embodiment. The beam-shaped portion 48 is a portion extending across opposed inner wall surfaces of a liquid storage chamber R that is defined by the housing 40. FIG. 8 exemplifies a configuration in which the beam-shaped portion 48 is formed in a second space RB2 of the liquid storage chamber R. Specifically, focusing on opposed inner wall surfaces 411 and 412 of the housing 40 that face each other at an interval in the X direction, the beam-shaped portion 48 according to the second embodiment projects from one of the inner wall surfaces 411 and 412 in the X direction and reaches the other. A distance between the inner wall surface 411 and the inner wall surface 412 corresponds to the second space RB2. For example, a configuration in which the beam-shaped portion 48 formed separately from the housing 40 is provided to the housing 40 or a configuration in which the beam-shaped portion 48 and the housing 40 are formed as one unit may be employed. Although FIG. 8 exemplifies one beam-shaped portion 48, a plurality of beam-shaped portions 48 may be preferably arranged at intervals in the Y direction. The housing 40 may include one or more beam-shaped portions 48 that are arranged in the Y direction. A space may be provided between adjacent beam-shaped portions such that the ink may flow in the liquid storage chamber R.

As exemplified in FIG. 8, one or more beam-shaped portions 328 may also be formed in a space RA of a channel substrate 32. The beam-shaped portion 328 is a portion extending across inner wall surfaces that face each other at intervals in the X direction in the space RA. The beam-shaped portions 328 may be integrally formed with the channel substrate 32 by processing a silicon single crystal substrate, for example. One or more beam-shaped portions 328 that are arranged in the Y direction may be formed. A space may be provided between adjacent beam-shaped portions such that ink may flow in the liquid storage chamber R to the space RA.

In the second embodiment, similar advantages as those of the first embodiment can be obtained. In the second embodiment, since the beam-shaped portion 48 is disposed in the housing 40, even a configuration in which the thickness of each part of the housing 40 is reduced in order to reduce the size of the liquid ejecting heads 26, for example, can advantageously maintain a mechanical strength of the housing 40. In the second embodiment, since the beam-shaped portion 328 is provided on the channel substrate 32 as well as the beam-shaped portion 48 of the housing 40, a mechanical strength of the channel substrate 32 (and further the overall strength of the liquid ejecting heads 26) can be maintained advantageously.

Figure 9:
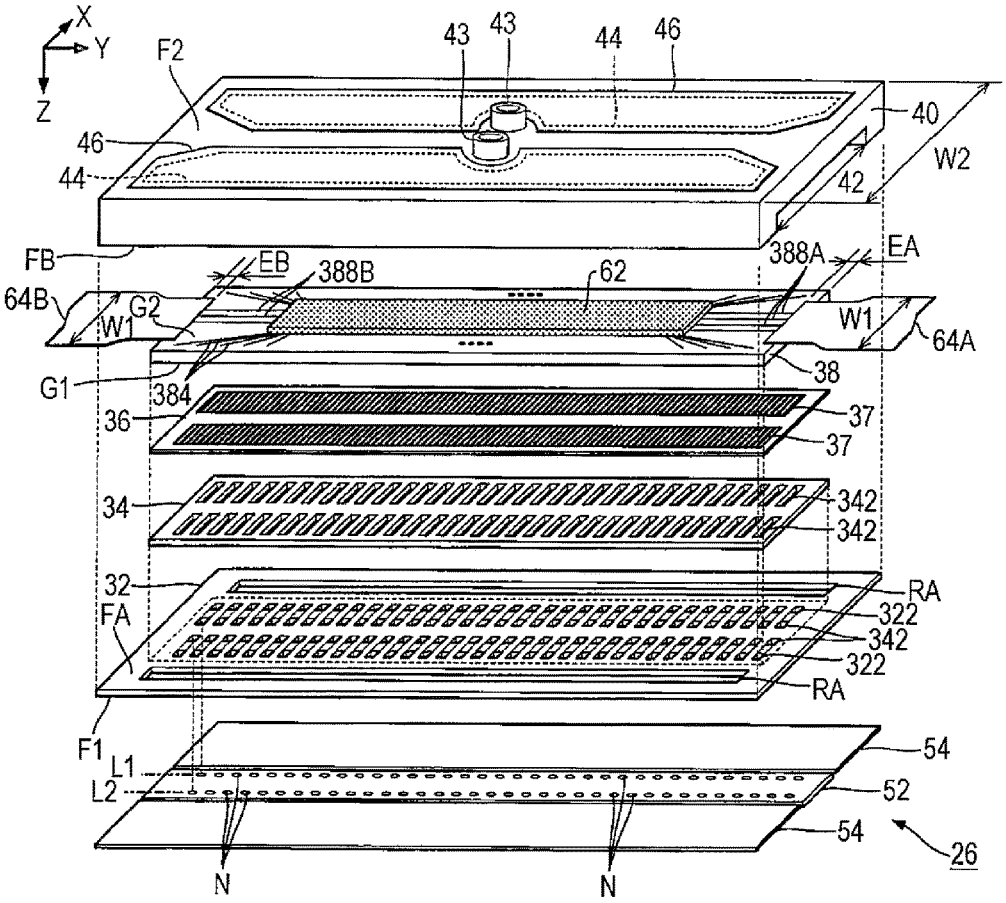
FIG. 9 is a disassembled perspective view of a liquid ejecting head according to a third embodiment.

FIG. 9 is a disassembled perspective view of a liquid ejecting head 26 according to a third embodiment. As exemplified in FIG. 9, the liquid ejecting head 26 according to the third embodiment includes a wire member 64A and a wire member 64B instead of the wire member 64 of the first embodiment.

Each of the wire member 64A and the wire member 64B is a mount component (e.g., an FPC or an FFC) including a plurality of wires (not shown) electrically connecting a control device 20 and a driver IC 62. The wire member 64A is joined to a region EA at a positive end of a mount surface G2 of a protective member 38 in a Y direction. The wire member 64B is joined to a region EB at a negative end of the mount surface G2 in the Y direction (that is, an end opposite to the wire member 64A). Each of the wire member 64A and the wire member 64B has a width W1 smaller than a width W2 of a housing 40.

As exemplified in FIG. 9, a plurality of wires 388A and a plurality of wires 388B are provided on the mount surface G2 of the protective member 38. The wires 388A and the wires 388B are electrically connected to the driver IC 62. The wires 388A extend to the region EA of the mount surface G2 and are electrically connected to wires of the wire member 64A. The wires 388B extend to the region EB of the mount surface G2 and are electrically connected to wires of the wire member 64B. As understood from the foregoing description, the driver IC 62 is electrically connected to the control device 20 through the wire member 64A and the wire member 64B.

In the configuration described above, a control signal and a power supply voltage for use in driving the piezoelectric elements 37 are supplied from the control device 20 to the driver IC 62 through the wire member 64A and the wire member 64B. Specifically, a control signal and a power supply voltage for driving some of the piezoelectric elements 37 at the positive side in the Y direction are supplied to the driver IC 62 through the wire member 64A and the wires 388A. A control signal and a power supply voltage for driving some of the piezoelectric elements 37 at the negative side in the Y direction are supplied to the driver IC 62 through the wire member 64B and the wires 388B.

The third embodiment can also obtain advantages similar to those of the first embodiment. In the configuration of the first embodiment in which the wire member 64 is disposed only at the positive side in the Y direction relative to the driver IC 62, a control signal or a power supply voltage supplied through the wire member 64 needs to transmitted from the positive end to the negative end in the Y direction inside the driver IC 62. Thus, a voltage drop in the inner wiring of the driver IC 62 can be noticeable. In contrast to the first embodiment, in the third embodiment, the wire member 64A is disposed at one side of the driver IC 62, and the wire member 64B is disposed at the other side. That is, a control signal and a power supply voltage are supplied from both ends of the driver IC 62 in the Y direction. Accordingly, as compared to the first embodiment, the third embodiment has an advantage of reducing a voltage drop in the inner wiring of the driver IC 62.

In the foregoing description, both the wire member 64A and the wire member 64B are used for transmitting a control signal and a power supply voltage. However, applications of the wire member 64A and the wire member 64B are not limited to the example described above. For example, the wire member 64A may be used for supplying a control signal with the wire member 64B being used for supplying a power supply voltage. The driver IC connected to the wire member 64A and the driver IC connected to the wire member 64*b* may be individually mounted on the protective member 38. For example, the driver IC at the positive end in the Y direction drives some of the piezoelectric elements 37 at the positive end in the Y direction by using a control signal and a power supply voltage supplied from the wire member 64A. On the other hand, the driver IC at the negative end in the Y direction drives some of the piezoelectric elements 37 at the negative end in the Y direction by using a control signal and a power supply voltage supplied from the wire member 64B. The third embodiment is applicable to the second embodiment including the beam-shaped portion 48 and the beam-shaped portion 328.

Variations

The foregoing embodiments may have variations. Examples of the variations will be specifically described. Two or more aspects of the following examples can be appropriately combined within a range where no contradiction arises.

(1) In the configurations of the above embodiments, both the damping body 46 and the damping body 54 are provided. Alternatively, in a case where a pressure variation in the liquid storage chamber R is negligible, for example, one or both of the damping body 46 and the damping body 54 may be omitted. In the configuration in which one or both of the damping body 46 and the damping body 54 are omitted, an advantage of reducing fabrication costs is obtained, as compared to the configuration in which both the damping body 46 and the damping body 54 are provided.

(2) An element (driver element) for applying a pressure to the inside of the pressure chamber C is not limited to the piezoelectric elements 37 described in the above embodiments. For example, a heating element that generates bubbles in the pressure chamber C by heat may be used as a driver element. The heating element is a portion in which a heat generating body generates heat by supplying a driving signal (specifically a region where bubbles are generated in the pressure chamber C). As understood from the examples described above, the driver element is generally expressed as an element for ejecting liquid in the pressure chamber C from the nozzles N (typically an element that applies a pressure to the inside of the pressure chamber C), and may be of any operating type (piezoelectric type or thermal type) and may have any configuration.

(3) In the above embodiments, the serial-type liquid ejecting apparatus 100 in which the conveyer 242 carrying the liquid ejecting heads 26 reciprocates is described as an example. The invention, however, is applicable to a line-type liquid ejecting apparatus in which a plurality of nozzles N are disposed across the entire width of a medium 12.

(4) The liquid ejecting apparatus 100 exemplified in the above embodiments is applicable not only to equipment dedicated to printing but also to various types of equipment such as a facsimile machine and a copying machine.

Applications of the liquid ejecting apparatus are not limited to printing. For example, a liquid ejecting apparatus for ejecting a solution of a coloring material can be used as a fabrication apparatus for forming a color filter of a liquid crystal display device. A liquid ejecting apparatus for ejecting a solution of a conductive material can be used as a fabrication apparatus for forming wires and electrodes of a wiring board.

What is claimed is:

1. A liquid ejecting head comprising:

a driver element that causes liquid in a pressure chamber to be ejected from a nozzle;

a liquid storage chamber that stores the liquid to be supplied to the pressure chamber; and a driver IC chip that drives the driver element, wherein at least a part of the liquid storage chamber overlaps both the driver element and the driver IC chip in plan view such that the liquid storage chamber is positioned above both the driver element and the driver IC chip in plan view and such that the liquid storage chamber, the driver IC chip, and the driver element are also all positioned above the nozzle in plan view, and wherein the liquid storage chamber includes:

a first space located at a side opposite to the driver element relative to the driver IC chip, and a second space located at a side of each of the driver IC chip and the driver element, and at least a part of the first space overlaps the driver element and the driver IC chip when viewed in plan view.

2. The liquid ejecting head according to claim 1, wherein the driver IC chip is disposed between the driver element and the liquid storage chamber.

3. The liquid ejecting head according to claim 1, further comprising:

a protective member including a housing space that houses the driver element, wherein the driver IC chip is disposed on a surface of the protective member opposite to the housing space.

4. The liquid ejecting head according to claim 1, wherein:

the driver element comprises a plurality of driver elements, the liquid ejecting head further comprises a wire member disposed at an end of a protective member in a direction in which the driver elements are arranged, and the wire member is electrically connected to the driver IC chip.

5. The liquid ejecting head according to claim 1, further comprising a first flexible damping body that is disposed on a first surface closer to the driver element than to the driver IC chip and constitutes a wall surface of the liquid storage chamber.

6. The liquid ejecting head according to claim 5, further comprising a second flexible damping body that is disposed on a second surface at a side of the driver element opposite to the driver IC chip and constitutes a wall surface of the liquid storage chamber.

7. A liquid ejecting apparatus comprising the liquid ejecting head according to claim 1.

8. A liquid ejecting apparatus comprising the liquid ejecting head according to claim 2.

9. A liquid ejecting apparatus comprising the liquid ejecting head according to claim 3.

10. A liquid ejecting apparatus comprising the liquid ejecting head according to claim 4.

11. A liquid ejecting apparatus comprising the liquid ejecting head according to claim 5.

12. The liquid ejecting head according to claim 1, further comprising:

a protective member including a housing space that houses the driver element;

a first flexible damping body that constitutes a wall surface of the liquid storage chamber; and a second flexible damping body that constitutes a wall surface of the liquid storage chamber and is discrete from the first flexible damping body.

13. The liquid ejecting head according to claim 12, wherein the driver IC chip is disposed between the driver element and the liquid storage chamber.

14. The liquid ejecting head according to claim 13, wherein the liquid storage chamber includes:

a first space located at a side opposite to the driver element relative to the driver IC chip, and a second space located at a side of each of the driver IC chip and the driver element, and at least a part of the first space overlaps the driver element and the driver IC chip when viewed in plan.

15. The liquid ejecting head according to claim 14, wherein the first flexible damping body is disposed on a first surface closer to the driver element than to the driver IC chip.

16. The liquid ejecting head according to claim 15, wherein the second flexible damping body is disposed on a second surface at a side of the driver element opposite to the driver IC chip.

17. The liquid ejecting head according to claim 1, further comprising:

a pressure chamber substrate comprising the pressure chamber which is in communication with the liquid storage chamber through a channel.

18. The liquid ejecting head according to claim 1, wherein the liquid storage chamber is in communication with multiple pressure chambers and spans an area above the multiple pressure chambers and beneath the multiple pressure chambers.

* * * * *